US006948204B2

(12) United States Patent
Chae

(10) Patent No.: US 6,948,204 B2
(45) Date of Patent: Sep. 27, 2005

(54) MATTRESS FOR BEDDING, AND METHOD AND APPARATUS FOR MANUFACTURING THE SAME

(75) Inventor: Jung-Soo Chae, Joogong-gocheung Apartment 1308-305 200, Haan3-Dong, Kwangmyung-Shi, Kyunggi-Do 423-063 (KR)

(73) Assignee: Jung-Soo Chae, Seoul (KR)

( * ) Notice: Subject to any disclaimer, the term of this patent is extended or adjusted under 35 U.S.C. 154(b) by 450 days.

(21) Appl. No.: 09/945,234

(22) Filed: Aug. 31, 2001

(65) Prior Publication Data

US 2004/0049856 A1 Mar. 18, 2004

Related U.S. Application Data

(63) Continuation-in-part of application No. PCT/KR00/00160, filed on Mar. 2, 2000.

(30) Foreign Application Priority Data

Mar. 4, 1999 (KR) ..... 1999-7131

(51) Int. Cl.[7] ..... A47C 27/18
(52) U.S. Cl. ..... 5/709; 5/712; 5/740; 5/739
(58) Field of Search ..... 5/706, 709, 712, 5/737, 739, 740

(56) References Cited

U.S. PATENT DOCUMENTS 3,205,106 A * 9/1965 Cross ..... 156/79
4,261,776 A * 4/1981 Lea et al. ..... 156/213
5,630,240 A * 5/1997 Matsuoka et al. ..... 5/653
5,642,546 A * 7/1997 Shoenhair ..... 5/680
6,190,486 B1 * 2/2001 Switlik ..... 156/213
6,446,289 B1 * 9/2002 Su et al. ..... 5/709

FOREIGN PATENT DOCUMENTS

| | | |
|---|---|---|
| JP | 48-17109 | 2/1973 |
| JP | 61-037214 | 2/1986 |
| JP | 04-295308 | 10/1992 |
| JP | 07-067749 | 3/1995 |
| KR | 90-202 | 1/1990 |
| KR | 1019990226611 | 7/1999 |

OTHER PUBLICATIONS

International Search Report from PCT/KR00/00160 in 3 pages.

* cited by examiner

*Primary Examiner*—Michael Trettel
(74) *Attorney, Agent, or Firm*—Knobbe, Martens, Olson & Bear LLP

(57) ABSTRACT

An air mattress includes top sheet and bottom sheet which are disposed to be opposing. The mattress has a side sheet coupled to the top and bottom sheets. The mattress has plural threads coupled to the top and bottom sheets so that they are spaced each other with a certain distance when the air is inflated. The mattress has a foamed body filled in the inside of the mattress so that the foamed body is penetrated by the threads.

31 Claims, 4 Drawing Sheets

*Fig.* 1
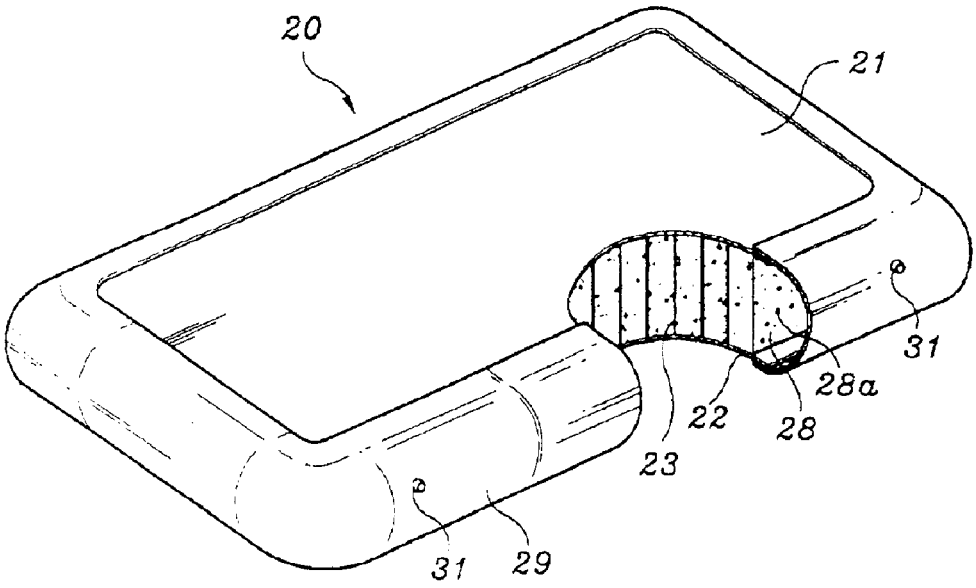

*Fig.* 2
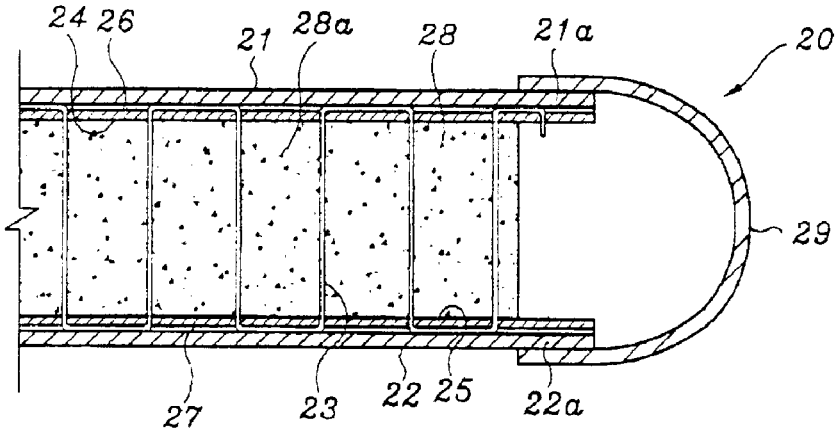
*Fig.* 3
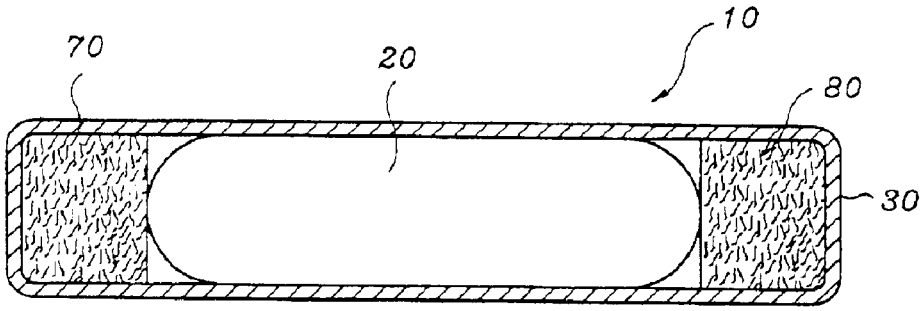

*Fig.* 4
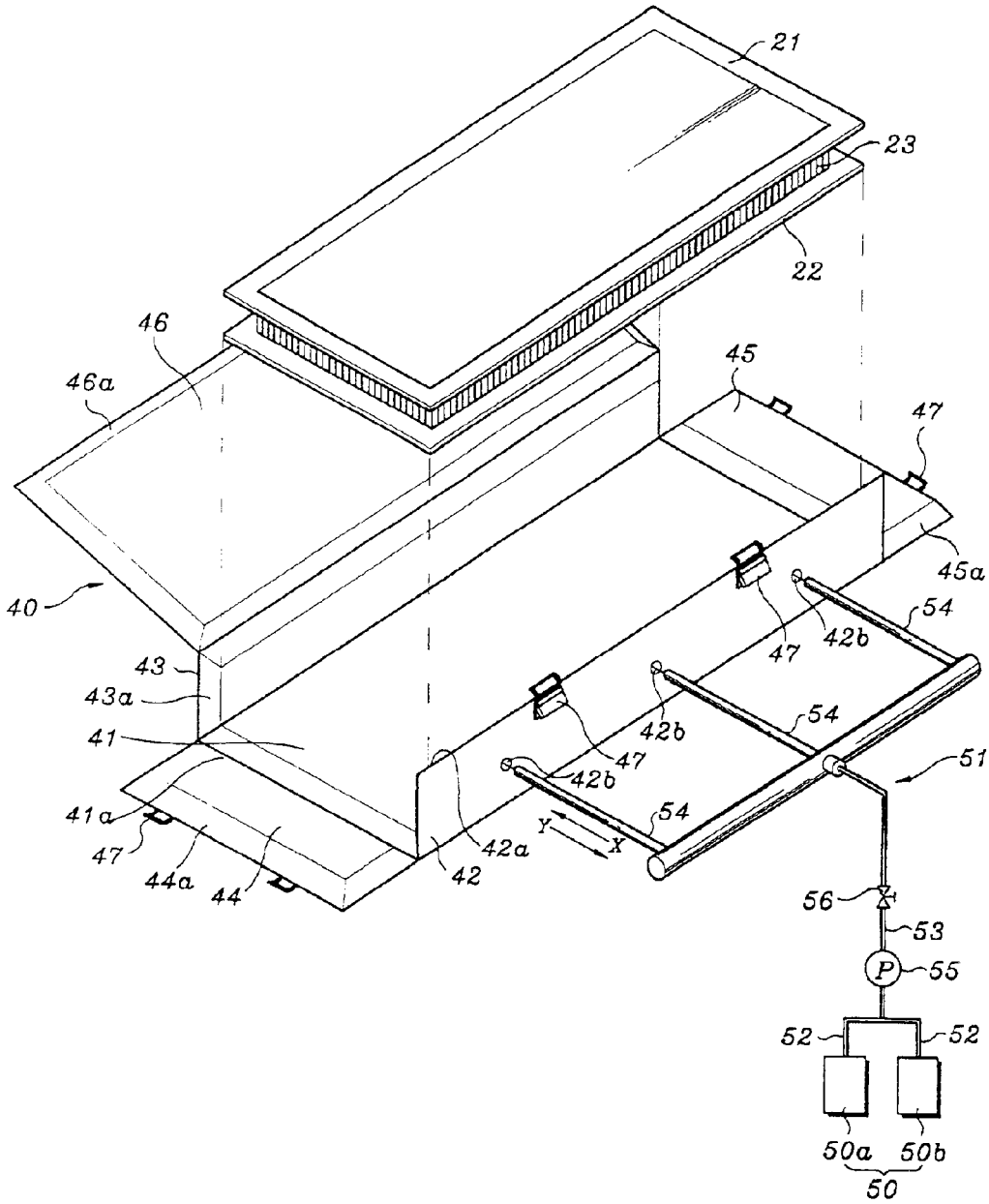

*Fig.* 5a
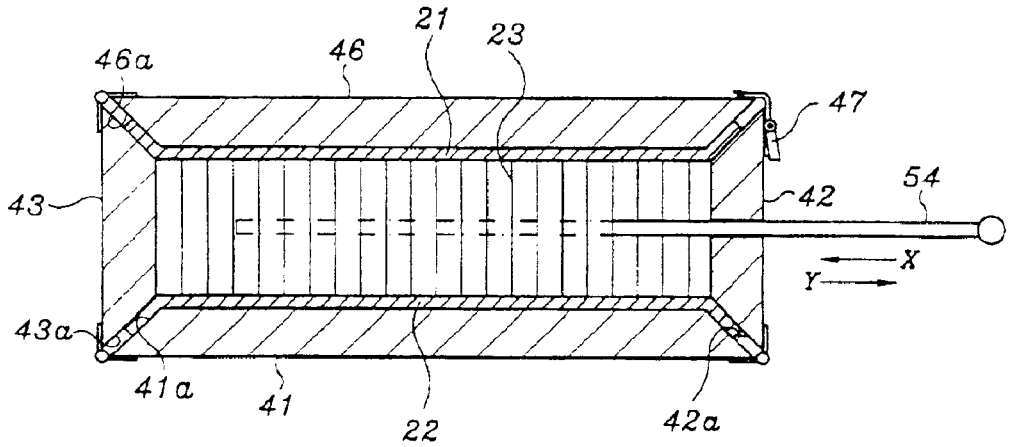
*Fig.* 5b
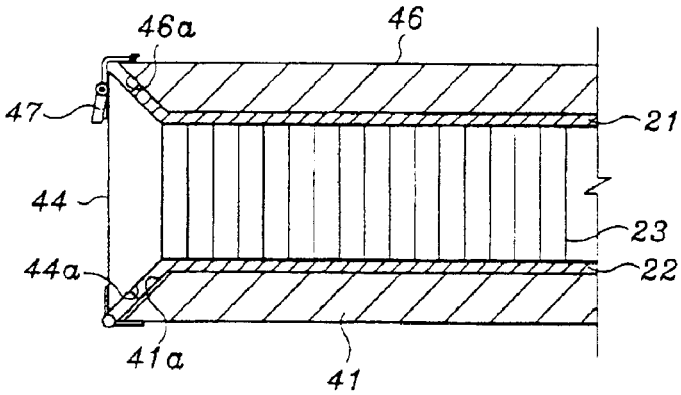

MATTRESS FOR BEDDING, AND METHOD AND APPARATUS FOR MANUFACTURING THE SAME

RELATED APPLICATIONS

This application is a continuation-in-part of PCT Application No. PCT/KR00/00160, filed Mar. 2, 2000, designating the United States and, therefore, having the effect of a U.S. national application for patent under 35 U.S.C. § 363, which claims the benefit of earlier filing date of Korean Patent Application No. 1999/7131, filed Mar. 4, 1999.

BACKGROUND OF THE INVENTION

The present invention relates to a mattress for bedding, and more particularly to a mattress for bedding with threads installed therein and having air tubes containing a foamed body in order to maintain the cushion and the shape of the mattress and to improve its durability and to a method and an apparatus for manufacturing the mattress.

A conventional mattress for bedding is a type of mattress with a plurality of coil springs disposed therein and configured to maintain the cushion and shape of the mattress by means of elastic force and elastic restoring force by the plurality of coil springs.

However, such a mattress that has coil springs therein is subject to severe vibrations as an impact applied to a portion of the mattress is transferred to the surroundings of that portion, and a user cannot arbitrarily adjust a degree of cushion of the mattress in accordance with his body since the elastic force of the coil springs is predetermined upon their manufacture. Further, since the elastic force and elastic restoring force of the coil springs are lowered and noise is generated when the coil springs are used for a long period, it is difficult to maintain the cushion and shape of the mattress and in turn the life of the mattress is shortened.

In order to make up for the drawbacks in the coil springs, an air mattress using air was developed previously. That is, the air mattress is configured so that the inner portion of the air mattress is divided into a plurality of partitions by bonding both ends of a respective I-beam to upper and lower inner surfaces of the air mattress and air is injected into each partition. The air mattress is adapted to maintain its cushion and shape by air pressure that is injected into each partition and to arbitrarily set the degree of cushion in conformity to a user's body by adjusting the air pressure.

However, since the air mattress with I-beams installed therein has a plurality of partitions divided widthwise or lengthwise of the mattress, air is moved within the same partition when pressure is applied to a certain portion. Therefore, since a portion to which pressure is applied is recessed due to the depression of the air mattress and the other portions to which pressure is not applied relatively expand and convexly protrude, there is a drawback that the air mattress has on the whole a level of irregularity.

Moreover, if the expansion and contraction of the air mattress are repeated as it is repeatedly used, stress is concentrated on the inner surfaces of the mattress and on both ends of the I-beams attached thereto, and thus, the bonded portions of the I-beams are detached, thereby deteriorating the function of cushion and the shape maintenance, resulting in a useless mattress.

The applicant proposed an air mattress using threads in Korean Patent No. 226611 in consideration of the problems occurred in a mattress using coil springs and an air mattress using I-beams as described above.

That is, the air mattress is configured so that the inner top and bottom surfaces having gastight property (gas impermeability) and liquid-tight property (liquid impermeability) are densely connected by threads, for example, with the density of three or more strands per one square centimeter and air is injected into the air mattress. The air mattress is adapted to maintain its shape with the expansion of the air mattress by the length of the threads.

If the inner top and bottom surfaces are densely connected by a number of threads as described above, even though pressure is applied to a certain portion of the air mattress, only the portion to which the pressure is applied is recessed and the other portions are prevented from further expanding by the length of the threads so that the other portions do not convexly protrude to maintain the shape of the air mattress and merely inner air pressure is slightly increased. Thus, the air mattress can be prevented from having on the whole a level of irregularity.

Further, since air pressure within the air mattress acts uniformly on the whole, stress affected on the individual thread is reduced and this stress is also dispersed due to the dense connections of the threads. Thus, there is no risk that connected portions of the threads are detached and so on, which results in the improvement of durability.

Although such an air mattress using threads described above is excellent, there is a further need for an air mattress that can maintain the cushion and shape of the mattress even when the air leakage occurs.

SUMMARY OF CERTAIN INVENTIVE EMBODIMENTS

The present invention is to solve the above problems in the prior art. Certain embodiments provide a mattress for bedding and a method and an apparatus for manufacturing the mattress, wherein vibrations due to impact can be reduced, the degree of cushion can be arbitrarily adjusted by a user in conformity to his body condition, and the life of the mattress can be extended by means of the improvement in the function of cushion and shape maintenance.

Certain embodiments provide a mattress for bedding having an air mattress in which time required for the injection of air can be shortened.

Certain embodiments provide a mattress for bedding and a method and an apparatus for manufacturing the mattress, wherein the mattress can be prevented from having a level of irregularity on the whole and the occurrence of failure due to stress concentration can be reduced.

Certain embodiments provide a mattress for bedding and a method and an apparatus for manufacturing the mattress, wherein the cushion and the shape of the mattress can be basically maintained even in the occurrence of an air leakage.

A mattress according to one aspect of the present invention comprises: a mattress skin defining an enclosed space, the mattress skin comprises first and second walls, wherein the walls are oppositely configured to each other; a plurality of strings interconnecting the walls within the enclosed space, each of the string having two ends, wherein one end connects with the first wall, and wherein the other end connects with the second wall; and a resilient material located within the enclosed space, wherein at least part of the strings are embedded in the resilient material while interconnecting the walls.

In the mattress, the first and second walls are arranged substantially parallel to each other. The mattress skin defines the enclosed space substantially air-tight or liquid-tight. The enclosed space is filled with gas or liquid. The strings interconnecting the walls are substantially perpendicular to the walls connected therewith. The strings are made of a substantially non-elastic material. A tensile strength of the string is 120 daN/cm or more. The strings are of substantially same in length. The strings interconnecting the walls through the resilient material are substantially straight. A string density is at least one string per one square centimeter of the inner surfaces. A string density may be at least three strings per one square centimeter of the inner surfaces. The resilient material substantially may fill up the enclosed space. The resilient material partly may fill the enclosed space. The resilient material comprises a porous body allowing gas or liquid to pass therethrough. The resilient material comprise a foam material. The resilient material is made of a resin selected from the group consisting of polyurethane, polyethylene, polypropylene, latex, polyvinyl chloride. The mattress further comprises an extra skin and a cushion member, wherein the extra skin encloses the mattress skin and the cushion member.

A method of manufacturing a mattress according to another aspect of the present invention comprises: providing first and second walls; interconnecting the walls with a plurality of strings, each string having two ends, wherein one end connects with the first wall, wherein the other end connects with the second wall, and wherein the walls are oppositely configured to each other; separating the interconnected opposite walls from each other with a distance so as to define a space therebetween; and providing a resilient material embedding at least part of the strings in the space while maintaining the inner surfaces separated.

The method further comprises coupling at least one wall with the first and second walls so as to enclose the space. The method further comprises filling gas or liquid into the enclosed space of the mattress. The providing resilient material comprises embedding at least part of the strings in the resilient material with the connections of the strings with the wall substantially intact. The providing resilient material comprises generating foam. The generation of foam comprises injecting a foam generating composition into the space and initiating foaming. The initiation of foaming comprises subjecting the composition injected in the space to an elevated temperature. The initiation of foaming comprises placing the intermediate for manufacturing a mattress in an oven at an elevated temperature. The distance between the wall are maintained substantially unchanged, during the providing resilient material.

Still another aspect of the present invention provides an apparatus for manufacturing a mattress for bedding, which has a top wall, a bottom wall and a lateral wall connecting the top and bottom wall. The apparatus comprises: a mattress mold including a bottom panel having a size corresponding to the bottom wall of said mattress, a side rim capable of being connected to said bottom panel and having a height corresponding to the lateral wall of said mattress, and a top panel to be connected to said side rim and having the size corresponding to a top surface of said mattress; a foam material supplying device for supplying a foam material having a tube extending within said mattress mold; and wherein margins of said bottom panel, side rim and top panel are provided with inclined surfaces abutted against each other when said panels and rim are assembled into a closed arrangement.

BRIEF DESCRIPTION OF THE DRAWINGS

The above and other objects, advantages and features of the invention will be apparent from a preferred embodiment of the invention described with reference to the accompanying drawings briefly described below.

FIG. 1 is a partially cut-away perspective view of a mattress according to an embodiment of the present invention;

FIG. 2 is an enlarged sectional view showing the inner structure of the mattress according to the embodiment shown in FIG. 1;

FIG. 3 is a sectional view showing an embodiment of the mattress according to the present invention, which may or may not incorporate the embodiment shown in FIG. 1;

FIG. 4 is a perspective view showing an embodiment of an apparatus for manufacturing a mattress according to the present invention; and FIGS. 5*a* and 5*b* are views for illustrating a method for manufacturing a mattress carried out by the apparatus for manufacturing the mattress according to the present invention.

DETAILED DESCRIPTION OF CERTAIN INVENTIVE EMBODIMENTS

Hereinafter, various features and aspects of the present invention will be explained in detail with reference to the embodiments illustrated in the accompanying drawings.

FIG. 1 is a partially cut-away perspective view showing an air mattress according to the present invention, FIG. 2 is an enlarged sectional view of a portion of the mattress according to the present invention, and FIG. 3 shows a mattress main body (assembly) on which an air mattress is mounted. A mattress main body 10 of the invention consists of an air mattress 20, first and second cushion members 70 and 80, and a cover 30 for wrapping the members (refer to FIG. 3).

The air mattress 20 includes a pair of top and bottom sheets 21 and 22 disposed opposite to each other on top and bottom sides, and the sizes of the top and bottom sheets 21 and 22 are set in accordance with the size of the mattress to be manufactured.

The top and bottom sheets 21 and 22 are connected by threads 23 so that the spacing between the top and bottom sheets 21 and 22 is maintained constantly when a foamed body 28 to be described later is inserted therein. That is, respective inner skins 24 and 25 are bonded to the top and bottom sheets by an adhesive. Adhesive layers 26 and 27 are formed between the top and bottom sheets 21 and 22 and the respective inner skins 24 and 25. The thread 23 penetrates the inner skin 24 on the side of the top sheet 21 and is fixed to the adhesive layer 26, and subsequently penetrates back the inner skin 24 on the side of the top sheet 21. Then, it penetrates the inner skin 25 on the side of the bottom sheet 22 and is fixed to the adhesive layer 27, and subsequently penetrates back the inner skin 25 on the side of the bottom sheet 22.

By repeating the above fixation process with the threads 23, the top and bottom sheets 21, 22 are densely and vertically connected with the threads 23. At this time, the lengths of the threads 23 connecting the top and bottom sheets 21 and 22 are made uniform so that the spacing between the top and bottom sheets 21 and 22 can be kept constant. In order to maintain the durability and the shape of the mattress, the sheets are connected, preferably, by at least one strand of thread 23 per one square centimeter, and most preferably, by three or more strands of threads 23 per one square centimeter.

A foamed body 28 is provided between the top and bottom sheets 21 and 22, more accurately, between the respective inner skins 24 and 25. The foamed body 28 is formed by filling a space between the top and bottom sheets 21 and 22 with a foam material and by foaming this material, which will be described later. With the foamed body 28, the top and bottom sheets 21 and 22 are configured to have a uniform spacing between them so that the mattress can maintain the shape as well as a desired cushion.

As the foam material for forming the foamed body 28, it includes a mixture of a foam resin such as polyurethane, polyethylene, polypropylene, latex, PVC, etc., with a foaming agent which is compatible with the foam resin and typically vaporizes above a certain temperature. After foaming of the foam material, the foaming agent vaporizes and forms fine cells (bubbles) 28*a* in the foamed body 28, so that the cushion of the foamed body 28 itself can be set in accordance with the amount of the foam material. It is preferred that the cells of the foamed body 28 are open cells.

Each thread 23 densely connected between the top and bottom sheets 21 and 22 is embedded in the foamed body 28 and spaced apart from each other by the foamed body 28. Numerous fine cells 28*a* are formed within the foamed body 28 and communicate with the outside of the foamed body 28 so that air can enter and leave the cells.

The top and bottom sheets 21 and 22 have wings (flaps) 21*a* and 22*a* extending outwardly from the regions in which the sheets are connected to each other by threads. A side sheet 29 is connected to the wings (flaps) 21*a* and 22*a*. As can be seen in FIG. 1, the side sheet 29 is attached around the entire margins of the top and bottom sheets 21 and 22.

The top and bottom sheets 21 and 22 and the side sheet 29 have impermeability against air (airtight property) and should be made of a material that can resist the inner air pressure. As the material for the sheets 21, 22 and 29, it includes a material having airtight property such as PVC, PU, rubber, etc. As the inner skin 23 and 24, woven fabric is used. Preferably, fabric woven from polyester or nylon 66 fiber is used. It is preferred that the thread 23 has tensile strength that can resist the inner air pressure. Preferably, the tensile strength is 120 daN/cm or more. It is preferred that the thread is made of a material consisting of polyester or nylon 66.

At least one air valve 30 is provided on a side of the air mattress 20.

As shown in FIG. 3, the mattress main body 10 according to the present invention may be configured to have several parts. Where bedding is configured to have several parts, it is preferred that the air mattress 20 according to the present invention is arranged only in the central portion of the bedding to which pressure is applied most greatly and that the cushion members 70 and 80 are disposed at front and rear portions, i.e., head and foot portions of the bedding. Although a cushion member made of any known material may be used, a cushion member made of palm fiber (cushion member made by dipping and fixing palm fiber into liquid latex) or other cushion members made of PE may also be used. Alternatively, the bedding may consist of only the air mattress 20.

Referring to FIG. 4, an apparatus for manufacturing the air mattress according to the present invention will be described. The apparatus for manufacturing the air mattress comprises a mattress mold 40 and a device for supplying a foam material to form the foamed body 28 by injecting the foam material into the mold 40.

The mold 40 comprises a bottom panel 41, two side panels 42 and 43, front and rear panels 44 and 45, and a top panel 46 having respective sizes that correspond to the bottom surface of the bottom sheet 22, the opposite side surfaces, the front and rear surfaces, and the top surface of the air mattress 20, respectively.

The opposite side panels 42 and 43 and front and rear panels 44 and 45 are connected to the bottom panel 41 in a manner that each of the panels 42, 43, 44, or 45 is able to be folded onto the bottom panel 41 at approximately 90 degrees. The top panel 46 is foldably connected to one of the side panels 43 at about 90 degrees. As shown in FIGS. 5*a* and 5*b*, inclined surfaces 41*a* to 46*a* that are preferably inclined at about 45 degrees are also formed at the margins of the bottom panel 41, side panels 42 and 43, front and rear panels 44 and 45, and top panel 46. The inclined surfaces abut against each other at a position where all the panels are closed. In the closed position, locking members 47 are mounted so as to fasten the front and rear panels 44 and 45 and side panel 42 to the top panel 46.

The foam material supplying device for injecting a foam material into the mattress mold 40 comprises a container 50 for storing the foam substance (or foam material) and a supplying line 51 for providing paths to feed the foam material into the mattress mold 40.

The foam material is obtained by mixing a foam liquid for forming the foamed body 28 and a foaming agent for forming fine cells 28*a* in the foamed body 28, at a predetermined ratio. Polyurethane, polyethylene, polypropylene, latex, PVC, etc. may be used as the foam liquid, and the polyurethane is more ideal. Any foaming agent may be used if it is supposed to evaporate, but the foaming agent should be compatible with the foam liquid. Any kinds of foam liquid and foaming agent that are known to a person skilled in the art may be used.

The container 50 includes a first storage container 50*a* for storing the foam liquid and a second storage container 50*b* for storing the foaming agent.

The supplying line 51 comprises feeding lines 52 that are separately connected to each of the first and second storing containers 50*a* and 50*b*, a main line 53 at which the feeding lines 52 are combined so that the foam liquid and foaming agent can be mixed with each other, and a plurality of branched injection lines 54 that are derived from the main line 53 and divided into several lines connected to the side panel of the mattress mold 40 so that the foam material can be uniformly and rapidly injected into the mold 40.

The injection lines 54 are constructed to reciprocally move in their linear direction as designated by the arrows shown in FIG. 4 with a conventional conveying device (not shown). Preferably, the injection lines 54 are constructed to inject the foam material into the mold 40 via through-holes 42*b* that are formed on the side panel 42 as they come out from the inner part of the inside of the mold 40 in a direction designated by an arrow Y. Alternatively, the mattress mold 40, instead of the injection lines 54, may be linearly displaced in a direction designated by the arrow X.

The supplying line 51 further includes a pump 55 for forcedly feeding the foam material into the main line 53 and a flow control valve 56 for controlling the amount of foam material to be injected.

Referring now to FIGS. 4, 5*a* and 5*b*, the operation of the apparatus for manufacturing the mattress as constructed above will be described together with a method for manufacturing the mattress. Firstly, as shown in FIG. 4, the top and bottom sheets 21 and 22 of the size corresponding to that of the mattress are disposed to face each other. The threads 23 are densely connected to all portions except for the wings 21*a* and 22*a* of the margins of the top and bottom sheets 21 and 22 with the top and bottom sheets 21 and 22 maintained at a constant spacing between them. It is preferred that three strands of threads 23 per 1 square centimeter of the top and bottom sheets 21 and 22 are connected to the sheets.

Then, the top and bottom sheets 21 and 22 that are connected to each other with the threads 23 are inserted into the mattress mold 40. As shown in FIGS. 5*a* and 5*b*, the margins of the top and bottom sheets 21 and 22 are inserted between two of the inclined surfaces 41*a* to 46*a* of the bottom panel 41, side panels 42 and 43, front and rear panels 44 and 45 and top panel 46. Thereafter, when the side panels 42 and 43, front and rear panels 44 and 45 and top panel 46 are folded into the closed position, the respective wing 21*a* or 22*a* of the margins of the top and bottom sheets 21 and 22 is pressed and fixed between the respective inclined surfaces 41*a* to 46*a*. The top and bottom sheets 21 and 22 are tightly stretched in a horizontal direction within the mattress mold 40 and at the same time, are maintained in a vertical direction at a constant spacing between them.

Next, the side panels 42 and 43, front and rear panels 44 and 45 and top panel 46 are fixed by the locking members 47. Then, the injection lines 54 of the supplying line 51 are moved in the direction designated by arrow X and inserted into the mattress mold 40 via the through holes 42*b*. Thereafter, the pump 55 is actuated and the foam liquid and foaming agent that are stored in the first and second storing containers 50*a* and 50*b*, respectively, are forcedly fed. The foam liquid and foaming agent are mixed in the main line 53 during their feeding. The mixed liquid is injected into the mattress mold 40 through the plurality of branched injection lines 54, and a first foaming of the mixed liquid is performed within the mold. At this time, the amount of foam material for injection is controlled by the flow control valve 56. Uniform injection can be achieved by moving the injection lines 54 from the inner part of the inside of the mattress mold 40 in the direction designated by the arrow Y while injecting the mixed liquid into the mold.

The first foaming of the foam material is performed at room temperature. After the first foaming is completed, a second foaming of the foam material is carried out at a temperature higher than room temperature. The second foaming may be carried out by, for example, putting the mattress mold 40 into an oven (not shown) and keeping a high temperature of about 80° C. for 20 minutes. When the second foaming is performed, the foam liquid is fully foamed and turned into the foamed body 28 having the fine cells 28*a*. Resulting foamed body 28 is formed between the top and bottom sheets 21 and 22 with the threads 23 being embedded therein.

Finally, the air mattress 20 of the present invention is produced by removing the mattress 20 from the mattress mold 40, attaching an airtight and liquid-tight side sheet 30 to the mattress 20 for the purpose of sealing, and pumping air into the air mattress 20 through valves 31.

Resulting air mattress 20 expands with the pressure of air as air is injected into the mattress 20 through the valves 31. Expansion of the mattress is controlled by the threads 23 that connect the top and bottom sheets 21 and 22, and thus the shape of the air mattress 20 remains constant.

The air mattress 20 becomes gradually harder if the inner air pressure continuously increases in a state that the mattress 20 does not expand any more. Accordingly, cushion of the air mattress 20 can be arbitrarily set by adjusting the air pressure within the air mattress 20 as mentioned above.

Furthermore, since the top and bottom sheets 21 and 22 of the air mattress 20 are constructed to be connected to each other by means of the dense threads 23, stress of the mattress due to a pressure or an impact is distributed and thus its durability is improved. The air tube 20 is also prevented from expanding beyond a certain limit. Therefore, even though a portion of the mattress 20 is pressed, merely the pressed portion is recessed and the other portion that is not pressed does not protrude and remains unchanged. Thus, the mattress 20 is prevented from having on the whole a level of irregularity and vibrations are not transmitted through the mattress.

On the other hand, even though air leaks out through the air valves 31, a basic shape of the mattress 20 is maintained as the foamed body 28 is provided within the mattress 20. Minimum cushion of the mattress 20 may also be maintained due to the inherent resiliency of the foamed body 28. Further, since the plurality of the threads 23 are separately embedded in the foamed body 28 and are spaced apart from each other, tangling of the thread 23 due to its slackness during contraction of the air mattress 20 is prevented.

Although the mattress 20 has been described in the form of an air mattress in the embodiments, the present invention is not limited to the above, and liquid such as water may be contained within the mattress 20.

As mentioned above, since the mattress for bedding according to the present invention is constructed such that its inner portions are connected with each other by the dense threads and the foamed body is provided within the mattress while the air is injected/inserted therein, the vibrations due to impact can be reduced and the cushion can be arbitrarily adjusted in accordance with a user's body. Upon use of the mattress, the mattress is prevented from having on the whole a level of irregularity, and the occurrence of failure due to stress concentration is reduced and thus its life can be extended. Further, the basic cushion and shape of the mattress can be maintained even though air may leak out from the air mattress. Furthermore, since the foamed body is provided within the air mattress, the amount of injected air can be reduced and thus the time for air injection can be shortened.

Although the present invention has been described with reference to the above preferred embodiments, it should be understood that any changes or modifications may be made without departing from the scope and spirit of the invention and that they will be within the scope of the present invention which is defined in the claims attached hereto.

What is claimed is:

1. A mattress comprising:

a mattress skin defining an enclosed space, the mattress skin comprising first and second walls, wherein the walls are oppositely configured to each other;

a plurality of strings interconnecting the walls within the enclosed space, each of the strings having two ends, wherein one end connects with the first wall, and wherein the other end connects with the second wall; and a resilient material located within the enclosed space, wherein at least part of the strings are embedded in the resilient material while interconnecting the walls, and wherein the resilient material partly fills the enclosed space.

2. The mattress of claim 1, wherein the first and second walls are arranged substantially parallel to each other.

3. The mattress of claim 1, wherein the mattress skin defines the enclosed space substantially air-tight or liquid-tight.

4. The mattress of claim 1, wherein the enclosed space is filled with gas or liquid.

5. The mattress of claim 1, wherein the strings interconnecting the walls are substantially perpendicular to the walls connected therewith.

6. The mattress of claim 1, wherein the strings are made of a substantially non-elastic material.

7. The mattress of claim 1, wherein a tensile strength of the string is 120 daN/cm or more.

8. The mattress of claim 1, wherein the strings are substantially the same length.

9. The mattress of claim 1, wherein the strings interconnecting the walls through the resilient material are substantially straight.

10. The mattress of claim 1, wherein a string density is at least one string per one square centimeter of inner surfaces of the first and second walls.

11. The mattress of claim 1, wherein a string density is at least three strings per one square centimeter of inner surfaces of the first and second walls.

12. The mattress of claim 1, wherein the resilient material comprises a porous body allowing gas or liquid to pass therethrough.

13. The mattress of claim 1, wherein the resilient material comprises a foam material.

14. The mattress of claim 1, wherein the resilient material is made of a resin selected from the group consisting of polyurethane, polyethylene, polypropylene, latex, polyvinyl chloride.

15. A mattress containing gas or liquid, comprising:

a pair of top and bottom sheets disposed to face each other on top and bottom sides;

threads connected to said top and bottom sheets so that said sheets can be maintained at a constant spacing when the mattress is filled with gas or liquid;

a side sheet connected to said top and bottom sheets; and a foamed body in which said threads between said top and bottom sheets are embedded, wherein said top and bottom sheets have respective wings at margins of said top and bottom sheets extending beyond portions in which said sheets are connected by said threads.

16. A mattress assembly comprising:

a mattress containing gas or liquid, at least one cushion member disposed on a lateral side of said mattress, and a cover for wrapping said mattress and said cushion member, wherein said mattress comprises:

a pair of top and bottom sheets disposed to face each other on top and bottom sides;

threads connected to said top and bottom sheets so that said sheets can be maintained at a constant spacing when the mattress is filled with gas or liquid;

a side sheet connected to said top and bottom sheets; and a foamed body in which said threads between said top and bottom sheets are embedded.

17. A method of manufacturing a mattress for containing gas or liquid, comprising:

placing top and bottom sheets to face each other, connecting said top and bottom sheets with threads except for margins of said top and bottom sheets, keeping said top and bottom sheets with a constant spacing by placing said sheets in a mattress mold and by securing said margins of said sheets to the mold, providing a foamed body by injecting a foam material into a space between said top and bottom sheets placed in said mattress mold and by initiating foaming of said foam material, and providing side walls connecting the top and bottom sheets, thereby forming an enclosed space defined by the side walls and top and bottom sheets, wherein the foam material partly fills the enclosed space.

18. A method of manufacturing a mattress, comprising:

providing first and second walls;

interconnecting the walls with a plurality of strings, each string having two ends, wherein one end connects with the first wall, wherein the other end connects with the second wall, and wherein the walls are oppositely configured to each other;

separating the interconnected opposite walls from each other with a distance so as to define a space therebetween; and providing a resilient material in the space while maintaining the inner surfaces separated, wherein at least part of the strings are embedded in the resilient material provided in the space, wherein the providing the resilient material comprises injecting a foam generating composition into the space and initiating foaming by subjecting the composition to an elevated temperature, wherein the injecting the foam generating composition into the space forms an intermediate structure for a mattress, and wherein the initiating foaming comprises placing the intermediate structure in an oven so as to subject the foam generating composition to the elevated temperature.

19. The method of claim 18, further comprising coupling at least one wall with the first and second walls so as to enclose the space.

20. The method of claim 19, further comprising filling gas or liquid into the enclosed space of the mattress.

21. The method of claim 18, wherein the providing resilient material comprises embedding at least part of the strings in the resilient material with the connections of the strings with the wall substantially intact.

22. The method of claim 18, wherein during the providing resilient material, the distance between the wall is maintained substantially unchanged.

23. A mattress comprising:

a mattress skin defining an enclosed space, the mattress skin comprising first and second walls, wherein the walls are oppositely configured to each other;

a plurality of strings interconnecting the walls within the enclosed space, each of the strings having two ends, wherein one end connects with the first wall, and wherein the other end connects with the second wall;

a resilient material located within the enclosed space, wherein at least part of the strings are embedded in the resilient material while interconnecting the walls; and an extra skin and a cushion member, wherein the extra skin encloses the mattress skin and the cushion member.

24. The mattress of claim 23, wherein the resilient material substantially fills up the enclosed space.

25. The mattress of claim 23, wherein the first and second walls are arranged substantially parallel to each other.

26. The mattress of claim 23, wherein the mattress skin defines the enclosed space substantially air-tight or liquid-tight.

27. The mattress of claim 23, wherein the enclosed space is filled with gas or liquid.

28. The mattress of claim 23, wherein the strings are made of a substantially non-elastic material.

29. The mattress of claim 23, wherein a string density is at least one string per one square centimeter of inner surfaces of the first and second walls.

30. The mattress of claim 23, wherein the resilient material comprises a porous body allowing gas or liquid to pass therethrough.

31. An apparatus for manufacturing a mattress for bedding, the mattress having a top wall, a bottom wall and a lateral wall connecting the top and bottom wall, comprising:

a mattress mold comprising a bottom panel, a side rim and a top panel, wherein the bottom panel is of a size corresponding to the bottom wall of said mattress, wherein the side rim is capable of being connected to said bottom panel and is of a height corresponding to the lateral wall of said mattress, and wherein the top panel is configured to be connected to said side rim and is of the size corresponding to a top surface of said mattress;

a foam material supplying device for supplying a foam material having a tube extending within said mattress mold; and wherein margins of said bottom panel, side rim and top panel are provided with inclined surfaces abutted against each other when said panels and rim are assembled into a closed arrangement.

* * * * *